United States Patent [19]

Mizuno et al.

[11] Patent Number: 4,518,324

[45] Date of Patent: May 21, 1985

[54] SEALED TYPE ELECTRICALLY OPERATED COMPRESSOR

[75] Inventors: Takao Mizuno; Naoshi Uchikawa; Akira Murayama; Takahiro Tamura, all of Shimizu, Japan

[73] Assignee: Hitachi, Ltd., Tokyo, Japan

[21] Appl. No.: 481,938

[22] Filed: Apr. 4, 1983

[30] Foreign Application Priority Data

Apr. 9, 1982 [JP] Japan ..... 57-58082

[51] Int. Cl.[3] ..... F04B 35/04; F04B 39/06; F04C 18/04

[52] U.S. Cl. ..... 417/366; 417/902; 417/DIG. 1; 418/55

[58] Field of Search ..... 418/55; 417/902, 312, 417/366, DIG. 1

[56] References Cited

U.S. PATENT DOCUMENTS

| | | | |
|---|---|---|---|
| 4,160,625 | 7/1979 | Dyhr et al. | 417/902 X |
| 4,160,629 | 7/1979 | Hidden et al. | 418/55 |
| 4,216,661 | 8/1980 | Tojo et al. | 418/55 X |
| 4,300,875 | 11/1981 | Fischer et al. | 418/55 |
| 4,365,941 | 12/1982 | Tojo et al. | 417/902 X |

FOREIGN PATENT DOCUMENTS

| | | | |
|---|---|---|---|
| 55-46081 | 3/1980 | Japan | 418/55 |
| 55-76485 | 5/1980 | Japan | 418/55 |
| 55-148994 | 11/1980 | Japan | 418/55 |
| 56-113090 | 9/1981 | Japan | 418/55 |

*Primary Examiner*—Carlton R. Croyle
*Assistant Examiner*—T. Olds
*Attorney, Agent, or Firm*—Antonelli, Terry & Wands

[57] ABSTRACT

A sealed type electrically operated compressor including a sealed container, and a pair of scroll members in the sealed container each having an end plate and a spiral wrap located in upright position thereon. The orbiting and the stationary scroll members are assembled with the respective wraps facing inwardly and meshing with each other, and the orbiting scroll member is rotated by an electric motor to move in orbiting movement to compress fluid in compression spaces defined by the two scroll members and discharge compressed fluid into a space in the container. A suction pipe defining a suction passage for the fluid to be led therethrough into the compression spaces extends at one end portion through the end plate of the stationary scroll member to open in a suction space defined by the two scroll members and extends at the other end portion through a wall of the sealed container axially to communicate with external equipment on the lower pressure side. The suction pipe is securely connected at one of two opposite end portions and non-securely connected at the other end portion to the end plate of the stationary scroll member and to the wall of the cylindrical sealed container. A gas sealing member is disposed at the end portion of the suction pipe that is non-securely connected.

7 Claims, 6 Drawing Figures

SEALED TYPE ELECTRICALLY OPERATED COMPRESSOR

BACKGROUND AND SUMMARY OF THE INVENTION

This invention relates to sealed electrically operated compressors of a scroll type, and more particularly, to a suction pipe connected to a compressor section of the scroll type compressor.

A sealed electrically operated scroll type compressor comprises a compressor section and a motor section contained in a sealed container. Fluid passages penetrate a wall of the sealed container and are connected through ducts to external equipment, such as an evaporator or a condenser, in the case of a refrigerating apparatus. The compressor section of the scroll type compressor comprises a portion having a fixed or stationary scroll member and an orbiting scroll member, with each scroll member including a spiral wrap of an involute curve or the like located in upright position on a respective end plate. A suction port for a fluid is located in a position close to an outer portion of spaces defined by the two scroll members meshing with each other, and an exhaust port opens in a position close to the center of the stationary scroll member.

An Oldham's ring is mounted between the orbiting scroll member and a frame or between the orbiting scroll member and the stationary scroll member to avoid rotation of the orbiting scroll member on its own axis. The orbiting scroll member is in engagement with a crankshaft through bearings with the crankshaft causing the orbiting scroll member to move in orbiting movement without rotating on its own axis, so that the fluid in sealed spaces defined between the two scroll members is compressed and the compressed fluid is discharged through the exhaust port. One example of the sealed electrically operated compressor of the scroll type of the aforesaid construction is disclosed in, for example Japanese Utility Model Application Laid-Open No. 76485/80.

In the sealed electrically operated scroll type compressor disclosed in the above-noted Japanese Publication, a suction pipe and an exhaust pipe extend through the wall of the sealed container and are connected to a suction port and a discharge port opening in the end plate of the stationary scroll member respectively. A refrigerant in a gaseous state of low pressure drawn by suction through the suction pipe is compressed in the sealed spaces and the compressed refrigerant of high pressure is discharged through the exhaust pipe to outside. Thus, in this type of compressor, the internal pressure of the container is kept at a level lower than the high pressure of the compressed fluid, and the temperature is lower than a compressor of the type in which discharged fluid is directly injected into the sealed container. In this type of compressor, the suction pipe may be directly joined as by welding to the wall of the sealed container and to the end plate of the stationary scroll member, because the internal pressure of the sealed container is low and there is no risk that the sealed container, particularly its upper cap section, might suffer deformation due to stress. In another type of compressor disclosed in, for example, Japanese Patent Application Laid-Open No. 46081/80the internal presssure of the sealed container becomes high, the differences in pressure might produce stress high enough to cause deformation to occur within the limit of elasticity and this phenomenon would not be negligible. The production of stress might subject the suction pipe to forced deformation, thereby causing crak formation to take place. If the crack formation occurs in the suction pipe, the fluid of high pressure in the sealed container would flow into the suction pipe and then into the compression chamber, so that the fluid can not be drawn by suction into the sealed container from the low pressure side of the refrigeration cycle and the refrigeration cycle can not be established. To avoid this trouble, in, for example, Japanese Patent Laid Open Application No. 148994/80, a proposal has been made to mount a suction pipe in a manner to keep it from coming into contact with an upper cap which is liable to suffer deformation.

In this proposal, the suction pipe is connected to an opening formed in a portion of an inner wall surface of the sealed container at which the stationary scroll member is fitted and secured in place. Thus, the suction pipe is not directly secured to the upper cap, so that the suction pipe is prevented from being subjected to forced deformation even if the upper cap is deformed due to stress, and the crack formation is prevented from occurring in the suction pipe.

When the suction pipe is connected to the sealed container in such a manner that it projects from the sealed container in a direction perpendicular to the axis of the sealed container, it is necessary to increase the thickness of the stationary scroll member in a portion thereof in which the suction pipe is connected thereto. Thus, this proposal would suffer the disadvantage that the overall size of the sealed container would increase.

This invention has as its object the provision of a sealed type electrically operated compressor including a sealed container of a compact size which prevents crack formation in the suction pipe which might otherwise be caused to occur by stress due to high pressure.

The aforesaid object is accomplished according to the invention by providing a suction pipe defining a suction passage which penetrates at one end portion thereof the end plate of the stationary scroll member to open in a fluid suction space defined by the stationary and the orbiting scroll members meshing with each other, and which extends at the other end portion thereof axially through a wall of the cylindrical sealed container to communicate with external equipment on the low pressure side, and a gas sealing member attached to the suction pipe, the suction pipe being securely connected at one of two opposite end portions to the wall of the cylindrical sealed container, and being non-securely connected at the other end portion to the end plate of the stationary scroll member so that the sealing member is attached to the end portion of the suction pipe that is non-securely connected.

DESCRIPTION OF THE PREFERRED EMBODIMENTS

The invention will now be described in detail by referring to the embodiments shown in the accompanying drawings.

Figure 1A:
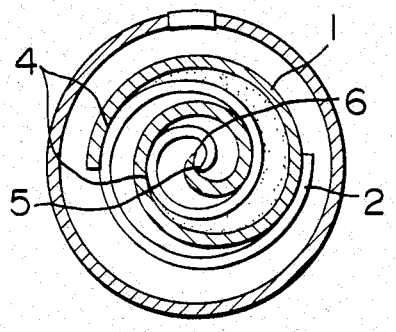
FIGS. 1*a*-1*d* are views in explanation of the principle of operation of a scroll fluid compressor.
Figure 1B:
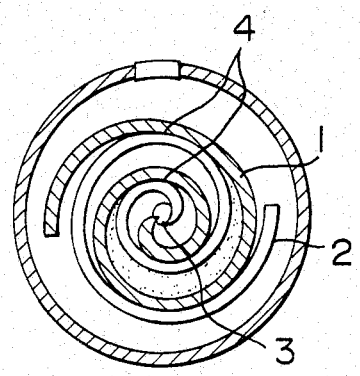
Figure 1D:
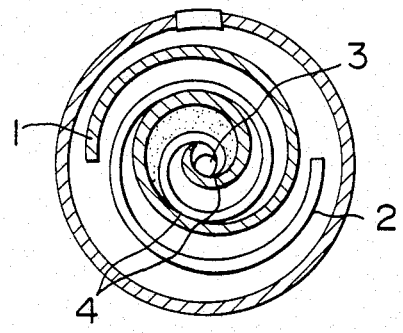
Figure 1C:
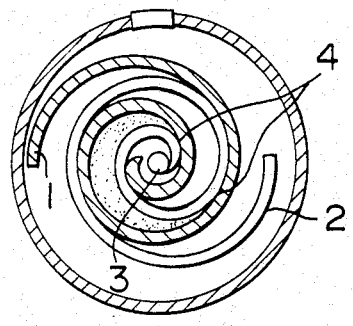

As shown in FIG. 1*a*, an orbiting scroll member 1 and a stationary scroll member 2 are both involute or similar curves. FIG. 1*a* shows the positions of the orbiting scroll member 1 and the stationary scroll member 2 relative to each other in a condition in which suction is completed and compression is just initiated, and FIGS. 1*b*, 1*c* and 1*d* show the two scroll members 1 and 2 rotated through 90°, 180° and 270°, respectively, from the position shown in FIG. 1*a* in a clockwise direction. The orbiting scroll member 1 has a center 5 which revolves in circular movement about the center 6 of the stationary scroll member 2, but does not rotate with respect to the center 5. Stated differently, the orbiting scroll member 1 does not rotate on its own axis. Revolving movement of the orbiting scroll member 1 will hereinafter be referred to as an orbiting movement. As the positions of the orbiting scroll member 1 and the stationary scroll member 2 shift from those shown in FIG. 1*a*. to those shown in FIGS. 1*b* and 1*c*, a sealed space defined by the two scroll members 1 and 2 is successively reduced in volume and fluid is compressed, and compressed fluid is discharged through an exhaust port 3 when it is brought into communication with the sealed space at a certain angle of revolution between the positions shown in FIGS. 1*d* and 1*a*. *Although two sealed spaces are defined by the two scroll members 1 and 2, the manner in which one sealed space has its volume reduced is shown, in the interest of brevity. As the orbiting scroll member 1 revolves through* 90° from the position shown in FIG. 1*d* to the position shown in FIG. 1*a*, the orbiting scroll member 1 has completed one orbiting movement about the center 6 of the stationary scroll member 2. In FIGS. 1*a*–1*d*, the sealed space is formed by radial contacts 4 between the two scroll members 1 and 2.

Figure 2:
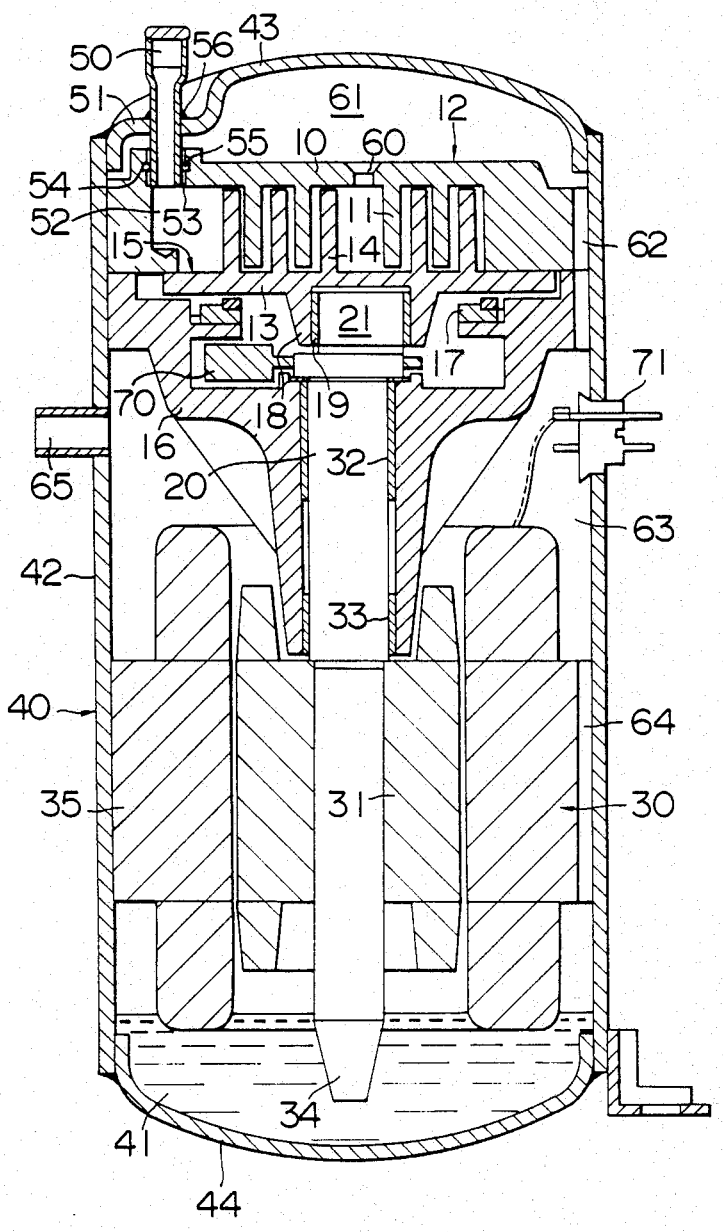
FIG. 2 is a sectional view of the sealed electrically operated compressor of the scroll type comprising one embodiment of the invention.

As shown in FIG. 2, a stationary scroll member generally designated by the reference numeral 12 includes an end plate 10 and a spiral wrap 11 disposed in upright position on the end plate, and an orbiting scroll member generally designated by the reference numeral 15 includes an end plate 13 and a spiral wrap 14 of essentially the same shape as the end plate 10 and the spiral wrap 11 of the stationary scroll member 12. The stationary and the orbiting scroll members are assembled with the wraps 11 and 14 facing inwardly and meshing with each other. An Oldham's ring 17 serves as a member for preventing the orbiting scroll member 15 from rotation on its own axis and is mounted between the orbiting scroll member 15 and a frame 16 connected to the stationary scroll member 12. A bearing boss 18 of the orbiting scroll member 15 supports an orbiting shaft portion 21 of a crankshaft 20 through a bearing 19. The crankshaft 20 is secured at its lower end portion to a rotor 31 of a motor 30 and rotatably journaled by the frame 16 through main bearings 32 and 33. The crankshaft 20 includes a lowermost end portion 34 which is immersed in an oil sump 41 in a bottom portion of a sealed container 40, so that oil can be supplied from the oil sump 41 through an oil feeding passage in the interior of the crankshaft 20 to the bearings 19, 32 and 33.

The sealed container 40 is composed of a cylindrical section 42, an upper cap section 43 and a lower cap section 44 joined together by welding. The motor 30 has a stator 35 fitted in the cylindrical section 42 and secured in place. The stationary scroll member 12 and the frame 16 are also fitted in the cylindrical section 42 and secured in place.

A suction pipe 50 defines a suction passage for introducing a fluid into a compression chamber of the compressor, with the suction pipe 50 being oriented axially of the cylindrical section 42 or in the direction in which the crankshaft 20 is disposed. The suction pipe 50 penetrates the upper cap section 43 to have its foward end portion inserted in the sealed container 40. A portion of the upper cap section 43 through which the suction pipe 50 extends is rendered flat as indicated at 51, to facilitate working on the wall of the upper cap section 43 to form an opening therein. The forward end portion of the suction pipe 50 inserted in the sealed container 40 extends through the end plate 10 of the stationary scroll member 12 and opens in a suction chamber 52 defined by the wraps 11 and 14 of the two scroll members 12 and 15. An opening 53 of a diameter slightly greater than the diameter of the suction pipe 50, is formed with an annular groove 54 fitted with an O-ring 55 formed of rubber, polytetrafluoroethylene, etc., to provide a gas seal. The suction pipe 50 is secured to the upper cap section 43 by welding as indicated at 56, but it is not secured to the end plate 10 of the stationary scroll member 12. An exhaust port 60 communicates with a space 61 within the sealed container 40. A compressed fluid passage 62 communicates with a lower space 63 in the sealed container 40. A passage 64 is formed in the stator 35 of the motor 30 and communicates with the oil sump 41. A discharge passage 65 is connected at one end to the lower space 63 in the sealed container 40 and at the other end to high pressure equipment outside the compressor, such as a condesner. A balance weight 70 is secured to the crankshaft 20, and a terminal 71 connects the stator 35 of the motor 30 to a power source.

In operation, the crankshaft 20 of the sealed type electrically operated compressor shown in FIG. 2 is driven to move the orbiting scroll member 15 in orbiting movement in a clockwise direction as seen from above. Compression chambers defined by the stationary and the orbiting scroll members 12 and 15 each move toward the center of the stationary scroll member 12 while having the volume reduced as the orbiting scroll member 15 moves in orbiting movement until they are successively communicated with the exhaust port 60 to discharge compressed fluid into the space 61. The fluid discharged into the space 61 is high in both temperature and pressure but flows through the passage 62 into the lower space 63 to effect cooling of the motor 30 of still higher temperature. In this process, oil mingling in the fluid is separated and flows through the passage 64 down into the oil sump 41, while the fluid in gaseous form is fed under pressure through the discharge passage 65 to outer equipment on the high pressure side.

When the sealed type electrically operated compressor of the aforesaid construction is used as a compressor of a refrigerating apparatus, the fluid led into the compressor chambers through the suction passage defined by the suction pipe 50 has a temperature and a pressure of substantially low level, and the fluid discharged into the space 61 from the compression chamber though the exhaust port 60 has a temperature and a pressure of substantially high level. Since the suction pipe 50 admitting the fluid of low temperature and pressure is connected to the end plate 10 of the stationary scroll member 12 after extending through the space 61 filled with the fluid of high temperature and high pressure, the suction pipe 50 is subjected to a high degree of pressure difference. The suction pipe 50 is joined by welding to the upper cap section 43 and influenced by the fluid of high temperature and high pressure in the space 61, so that it would be deformed within its limit of elasticity due to stress caused by the high pressure and high temperature. In the invention, however, the suction pipe 50 is connected to the stationary scroll member 12 through the O-ring 55 fitted in the annular groove 54 formed in the opening 53 to provide a gas seal. By virtue of this arrangement, no stress is produced in the suction pipe 50 due to the shock-absorbing function of the O-ring 55 even if the suction pipe 50 is subjected to forced deformation, thereby enabling crack formation in the suction pipe 50 to be avoided.

Figure 3:
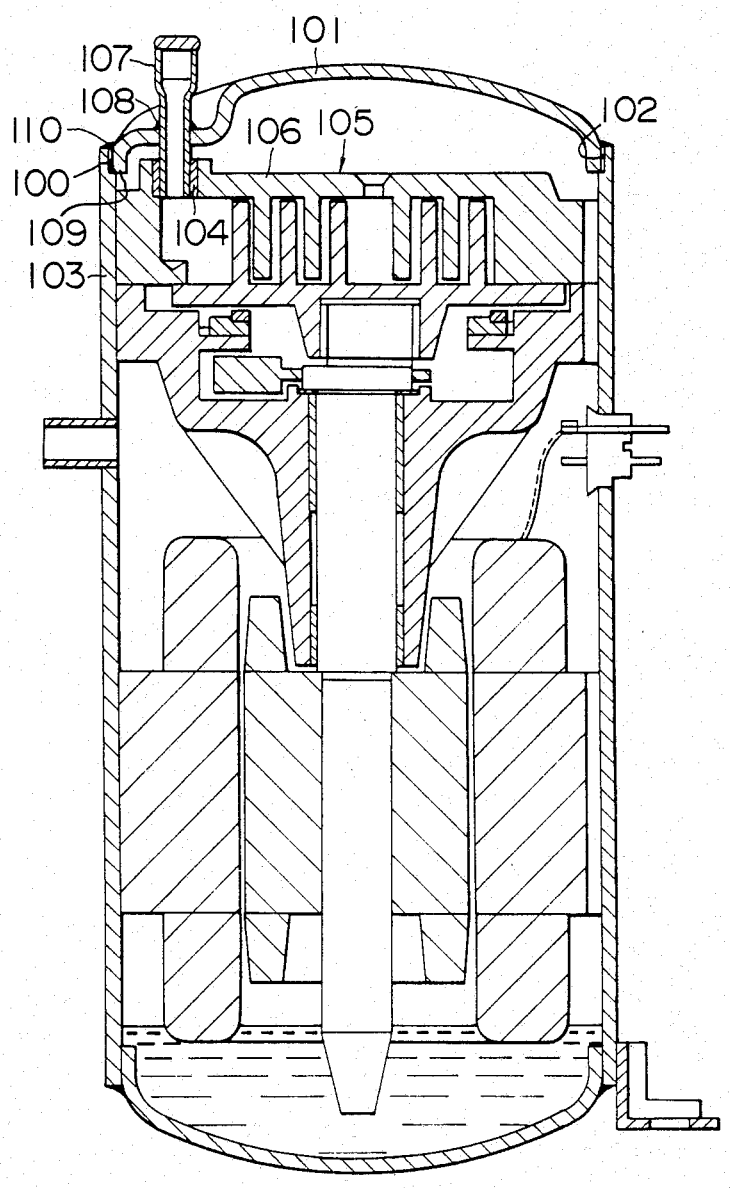
FIG. 3 is a sectional view of the sealed electrically operated compressor of the scroll type comprising another embodiment.

In FIG. 3, opening formed in a stationary scroll member generally designated by the reference numeral 105 for the suction pipe 107 to extend therethrough has a gas sealing member, such as a polytetrafluoroethylene sleeve 104, fitted therein, and the portion of the upper cap section 101 for the suction pipe 107 to be secured thereto includes a stepped spigot joint 100 to facilitate positioning of the suction pipe 107 when the latter is inserted in the opening formed in the stationary scroll member 105. An inner wall surface 102 of a diameter slightly larger than the outer diameter of an upper cap 101 is formed at an upper end portion of a cylindrical section 103. The sleeve 104 of polytetrafluoroethylene is fitted in an end plate 106 of a stationary scroll member 105 to provide a gas seal.

A suction pipe 107, defining a suction passage, is joined as by welding to the upper cap 101 as indicated at 108, and the suction pipe 107 is not secured to the end plate 106 of the stationary scroll member 105 but merely connected thereto while having a gas seal provided by the seal 104 of polytetrafluoroethylene. Once the suction pipe 107 is fitted in the sleeve 104 and positioned therein, the upper cap 101 is pressed downwardly to have its end face 109 abutted against a lower surface of the spigot joint 100 to prevent further downward movement of the upper cap 101. Thus, the suction pipe 107 can be accurately positioned. Moreover, since the end face 109 of the upper cap 101 is in contact with the lower surface of the stepped spigot joint 100 over the entire surface, there is positively no risk of spatter dropping into the sealed container when the upper cap 101 is joined by welding to the cylindrical section 103 as indicated at 110.

From the foregoing description, it will be appreciated that according to the invention, the suction pipe defining a suction passage developing stress due to the high pressure of fluid can be kept from undergoing forced deformation, thereby enabling the trouble of crack formation to be avoided.

What is claimed is:

1. An electrically operated compressor of a sealed type comprising:

a sealed container of a cylindrical shape;

a compressor section and an electric motor section contained in said sealed container;

said compressor section comprising a stationary scroll member including an end plate secured to an upper end portion of said sealed container, and a spiral wrap disposed in upright position on the end plate, an orbiting scroll member including an end plate and a wrap of essentially the same shape as the end plate and the wrap of the stationary scroll member, and a frame connected to the stationary scroll member in a manner to enclose the orbiting scroll member between the frame and the stationary scroll member;

said electric motor section being located below said compressor section and comprising a stator secured to a lower portion of said sealed container, and a rotor secured to a lower portion of a crankshaft journaled by bearing portions of said orbiting scroll member and of said frame of said compressor section;

a member for preventing said orbiting scroll member from rotation on its own axis during its orbiting movement, and being mounted between the frame and the orbiting scroll member;

an oil sump in a bottom portion of said sealed container of the cylindrical shape to allow oil feeding means formed in a lower portion of said crankshaft to be immersed in oil;

a discharge passage extending through the end plate of the stationary scroll member to discharge compressed fluid at a high pressure into an upper space in said sealed container;

a suction pipe defining a suction passage extending through said upper space and having two end portions, one of said two end portions extending through the end plate of the stationary scroll member to open in a fluid suction space defined between the stationary scroll member and the orbiting scroll member in meshing engagement with each other and the other end portion axially extending through a wall of said sealed container of cylindrical shape to communicate with an outer equipment on the lower pressure side, said suction pipe being secured to one of the end plate and the wall of the container and connected in non-secured condition to the other of the end plate and the wall of the container; and a gas sealing member disposed between said suction pipe and the other of the end plate of the stationary scroll member and the wall of the container.

2. An electrically operated compressor of a sealed type as claimed in claim 1, wherein said suction pipe is joined by brazing to the wall of said sealed container of the cylindrical shape, and said gas sealing member is disposed at a portion at which the suction pipe is inserted into the end wall of the stationary scroll member.

3. An electrically operated compressor of a sealed type as claimed in claim 2, wherein said gas sealing member comprises an O-ring.

4. An electrically operated compressor of a sealed type as claimed in claim 2 wherein said gas sealing member comprises a sleeve of polytetrafluoroethylene.

5. An electrically operated compressor of a sealed type as claimed in claim 1 wherein said sealed container of the cylindrical shape includes a cylindrical section, an upper cap section and a lower cap section, and said suction pipe extends through the wall of the upper cap section axially of the sealed container.

6. An electrically operated compressor of a sealed type as claimed in claim 5 wherein a portion of the wall of the upper cap section for the suction pipe to extend therethrough is a planar portion substantially perpendicular to the suction pipe.

7. An electrically operated compressor of a sealed type as claimed in claim 5 wherein a stepped spigot joint is formed at a portion of the cylindrical section of the sealed container at which the upper cap section is fitted to the cylindrical section to allow the stepped portion to be brought into contact with an end face of the upper cap section over the entire surface, and a gap is formed in said stepped spigot joint so as to adjustably connect the spigot joint to the upper cap section.

* * * * *